US010313803B2

(12) United States Patent
Rosenkranz et al.

(10) Patent No.: US 10,313,803 B2
(45) Date of Patent: Jun. 4, 2019

(54) METHOD FOR SUPPRESSING FEEDBACK IN A HEARING INSTRUMENT AND HEARING INSTRUMENT

(71) Applicant: SIVANTOS PTE. LTD., Singapore (SG)

(72) Inventors: Tobias Daniel Rosenkranz, Erlangen (DE); Tobias Wurzbacher, Erlangen (DE)

(73) Assignee: Sivantos Pte. Ltd., Singapore (SG)

( * ) Notice: Subject to any disclaimer, the term of this patent is extended or adjusted under 35 U.S.C. 154(b) by 172 days.

(21) Appl. No.: 15/254,132

(22) Filed: Sep. 1, 2016

(65) Prior Publication Data

US 2017/0064464 A1 Mar. 2, 2017

(30) Foreign Application Priority Data

Sep. 2, 2015 (DE) ..... 10 2015 216 822

(51) Int. Cl.
*H04R 25/00* (2006.01)

(52) U.S. Cl.
CPC ..... *H04R 25/453* (2013.01); *H04R 25/305* (2013.01); *H04R 25/353* (2013.01); *H04R 2225/41* (2013.01)

(58) Field of Classification Search
CPC .. H04R 25/453; H04R 25/305; H04R 25/353; H04R 2225/41
USPC ..... 381/318
See application file for complete search history.

(56) References Cited

U.S. PATENT DOCUMENTS 7,853,031 B2 12/2010 Hamacher
8,345,902 B2 1/2013 Ma et al.
8,437,482 B2 * 5/2013 Seefeldt ..... G10L 25/48 381/104

(Continued)

FOREIGN PATENT DOCUMENTS

CN 102149038 A 8/2011
CN 102695114 A 9/2012

(Continued)

OTHER PUBLICATIONS

Kuk, Francis, et al.: "Understanding Feedback and Digital Feedback Cancellation Strategies," The Hearing Review, Bd. 9, Nr. 2, Feb. 28, 2002, pp. 36-49.

*Primary Examiner* — Sean H Nguyen
(74) *Attorney, Agent, or Firm* — Laurence A. Greenberg; Werner H. Stemer; Ralph E. Locher

(57) ABSTRACT

A method suppresses feedback in a hearing instrument. A microphone generates an input signal and a loudspeaker generates an acoustic signal which is partially fed back to the microphone via an acoustic feedback path. An intermediate signal is generated along a main signal path depending on the input signal, and an output signal is formed on the basis of the intermediate signal. A voice activity of a user is monitored, a transfer function of an electro-acoustic closed signal loop formed by the main signal path and the feedback path is estimated, that, depending on the transfer function of the closed signal loop and the voice activity of the user, the intermediate signal is decorrelated to form the output signal. A compensation signal is generated from the output signal and is fed to the input signal for feedback compensation, and the output signal is fed to the loudspeaker for reproduction.

8 Claims, 2 Drawing Sheets

(56) References Cited

U.S. PATENT DOCUMENTS

| | | | | |
|---|---|---|---|---|
| 8,976,988 | B2 | 3/2015 | Pedersen | |
| 9,269,343 | B2 | 2/2016 | Munk et al. | |
| 9,398,380 | B2 | 7/2016 | Rosenkranz et al. | |
| 2005/0100179 | A1* | 5/2005 | Behboodian | H03G 3/007 381/106 |
| 2007/0217639 | A1* | 9/2007 | Stirnemann | H04R 25/70 381/321 |
| 2011/0064252 | A1* | 3/2011 | Ma | H04R 25/453 381/312 |
| 2013/0294616 | A1* | 11/2013 | Mulder | H04R 3/005 381/71.1 |
| 2014/0146977 | A1 | 5/2014 | Munk et al. | |
| 2015/0092966 | A1 | 4/2015 | Andersen et al. | |
| 2016/0080875 | A1 | 3/2016 | Rosenkranz et al. | |
| 2016/0302016 | A1 | 10/2016 | Rasmussen | |

FOREIGN PATENT DOCUMENTS

| | | | |
|---|---|---|---|
| CN | 103841497 | A | 6/2014 |
| CN | 104125526 | A | 10/2014 |
| DE | 102005032274 | A1 | 1/2007 |
| DE | 102013207403 | B3 | 3/2014 |
| DE | 102014218672 | B3 | 3/2016 |
| EP | 2237573 | A1 | 10/2010 |
| EP | 2835985 | A1 | 2/2015 |
| WO | 2013189528 | A1 | 12/2013 |

* cited by examiner

METHOD FOR SUPPRESSING FEEDBACK IN A HEARING INSTRUMENT AND HEARING INSTRUMENT

CROSS-REFERENCE TO RELATED APPLICATION

This application claims the priority, under 35 U.S.C. § 119, of German application DE 10 2015 216 822.0, filed Sep. 2, 2015; the prior application is herewith incorporated by reference in its entirety.

BACKGROUND OF THE INVENTION

Field of the Invention

The invention relates to a method for suppressing feedback in a hearing instrument, in particular a hearing aid, wherein a microphone of the hearing instrument generates an input signal and wherein a loudspeaker of the hearing instrument generates an acoustic signal which is partially fed back to the microphone. An intermediate signal is formed along a main signal path depending on the input signal, and an output signal is formed on the basis of the intermediate signal, and the output signal is fed to the loudspeaker for reproduction.

In hearing instruments, feedback, i.e. a pick-up by a microphone of the hearing instrument of a sound signal generated by a loudspeaker of the hearing instrument and an accompanying further amplification in the internal signal path, is a frequently occurring problem due to the short distances between the microphone and loudspeaker and the often high sensitivity of the microphones that are used.

Algorithms for frequency distortion, such as e.g. frequency shifting, phase modulation or frequency compression are often used in feedback suppression, since these algorithms decorrelate the signal picked up by the microphone and the sound signal generated by the loudspeaker from one another. A decorrelation of this type results in a more robust adaptation in algorithms for adaptive feedback cancellation and therefore a faster suppression of hissing noises which occur due to feedback. Moreover, errors in the adaptation which may result in audible artefacts in the signal of the hearing instrument can be prevented to a substantial extent.

Depending on the design, ear mold and patient-specific adaptation of the hearing instrument, a part of the ambient noise may enter the auditory canal of the user along with the sound signal generated by the loudspeaker. As a result, the "real" sound signal from the environment and the frequency-distorted sound signal of the loudspeaker are superimposed on one another. While the frequency-distorted sound signal alone can be perceived by a user as being of high quality, the perception of the sound signal resulting from the superposition is usually unpleasant. A frequency shift (i.e. a shift of the frequency of the loudspeaker signal in relation to the original signal along the frequency axis by a specific amount) may result in an audible modulation in the form of beats which manifest themselves depending on the amount of the frequency shift as whirring or rattling interfering noise.

For a user of the hearing instrument, the superposition of the sound of his own voice with a frequency-distorted signal thereof is usually perceived as particularly irritating. Since the sound of the user's own voice is also conducted through the cranial bone to the auditory canal, this problem exists regardless of the design of the ear mold, and cannot therefore be readily overcome, e.g. through a more effective sealing of the auditory canal (which in turn would moreover only cause further problems such as occlusion effects).

A method for controlling an adaptation step width of an adaptive filter of a hearing apparatus for feedback reduction is disclosed in German patent DE 10 2013 207 403 B3, corresponding to U.S. Pat. No. 9,398,380. For this purpose, an autocorrelation value is obtained from sampling values of a microphone signal between which a time difference exists, and the adaptation step width of the adaptive filter is controlled on the basis of the autocorrelation value. A frequency of an output signal obtained on the basis of the microphone signal is shifted in the generation of the earpiece signal and the time difference for obtaining the autocorrelation value is controlled depending on the shift of the frequency of the microphone signal.

German patent DE 10 2014 218 672 B3, corresponding to U.S. patent disclosure No. 2016/0080875, discloses a method and an apparatus for feedback suppression. In the method, a first transfer function is estimated for a first portion of a signal response which contains a feedback path. A power of a feedback signal of a second transfer function of the feedback path is estimated for a second portion of the signal response and a parameter of the signal processing device and/or the feedback suppression unit is set depending on the estimated power.

Published, non-prosecuted German patent application DE 10 2005 032 274 A1, corresponding to U.S. Pat. No. 7,853,031, shows a method for own voice detection. It is provided here to detect a user's own voice with a special analysis device and to control the hearing instrument algorithms depending thereon. This can be achieved by a microphone in the auditory canal, the signal level of which is compared with that of an external microphone. For example, the automatic amplification control of a hearing instrument can thus be blocked in the presence of the user's own voice.

SUMMARY OF THE INVENTION

The object of the invention is to indicate a method for suppressing feedback in a hearing instrument which is intended to enable the highest possible sound quality in the output signal and is intended to achieve the most pleasant possible auditory perception for the user of the hearing instrument in conversation situations.

The aforementioned object is achieved according to the invention by a method for suppressing feedback in a hearing instrument, in particular a hearing aid. A microphone of the hearing instrument generates an input signal and a loudspeaker of the hearing instrument generates an acoustic signal which is partially fed back to the microphone via an acoustic feedback path. An intermediate signal is generated along a main signal path depending on the input signal, and an output signal is formed on the basis of the intermediate signal. It is provided here that a voice activity of a user of the hearing instrument is monitored, a transfer function of an electro-acoustic closed signal loop formed by the main signal path and the feedback path is estimated, and that, depending on the transfer function of the closed signal loop and on the voice activity of the user of the hearing instrument, the intermediate signal is decorrelated to form the output signal and a compensation signal is generated on the basis of the output signal and is fed to the input signal for feedback compensation, wherein the output signal is fed to the loudspeaker for reproduction. Advantageous and, in some instances, individually inventive designs form the subject-matter of the subclaims and the following description.

Here, a microphone generally contains any input converter which is configured to convert a sound signal into an electrical signal. A loudspeaker similarly contains any electro-acoustic converter which is configured to generate a sound signal from an electrical signal. In particular, the input signal is, at least in some cases, decoupled from the main signal path into a secondary signal path in which the compensation signal is generated which is fed to the input signal to compensate for the feedback. The intermediate signal is decorrelated here, in particular, by means of a frequency distortion which also contain, inter alia, an—if necessary time-dependent—frequency shift and a phase modulation.

A possible solution to the aforementioned problem would be to leave the decorrelation generally inactive and only to activate it as soon as a feedback-based whistling is detected. As a result, the user of the hearing instrument perceives his own voice identically through a direct sound transfer and through the signal path of the hearing instrument; interference, beats or an unpleasant whirring do not occur. An inactive decorrelation between the microphone signal and the output signal to be reproduced by the loudspeaker is preferably taken into account by algorithms applied in the hearing instrument to suppress or cancel feedback. The algorithms are either similarly to be deactivated, or operate preferably with significantly slower time constants than in the case of an active decorrelation in order to prevent tonal components of the input signal from being eliminated as a result of the high existing correlation between the input signal, which represents the sound signal of the environment, and the output signal by the compensation signal generated on the basis of the output signal, which would result in audible, unwanted artefacts. However, one disadvantage of the resulting on-demand feedback suppression is that a system of this type must always first detect a feedback whistling before the decorrelation is activated and the feedback can be effectively suppressed. The system cannot therefore easily be completely freed from interference due to feedback. This applies, in particular, to interfering noises below an activation threshold for the decorrelation and the suppression of feedback.

As an alternative solution, it is now indicated by the method to carry out the decorrelation of the intermediate signal to form the output signal and the suppression of feedback in the input signal on the basis of the compensation signal formed from the output signal depending on the voice activity of the user of the hearing instrument and depending on the transfer function of the closed signal loop which is formed from the acoustic feedback path and the main signal path. In particular, this involves modifying the decorrelation as soon an activity of the hearing instrument user's own voice is detected. This modification of the decorrelation is performed under the constraint that the total amplification of the closed signal loop (closed loop gain) does not reach critical levels due to the modification of the decorrelation and due to any resulting modifications for feedback suppression.

Future generations of hearing instruments will offer the facility to detect whether the user of the hearing instrument is himself currently speaking (own voice detection, OVD). This offers the facility, in particular, to attenuate or totally deactivate the decorrelation as soon as the OVD indicates an activity of the user's own voice. Furthermore, the transfer function of the closed signal loop (closed-loop transfer function, CLTF) of the hearing instrument is continuously monitored, and the frequency distortion is modified only if the total amplification of the CLTF lies below a specific limit value. This procedure can prevent the occurrence of unwanted whistling noises as a result of a modification of the decorrelation, for example in the form of an attenuation or total stoppage, and resulting consequences for the feedback suppression process.

Here, the CLTF is preferably to be calculated from the internal transfer function of the hearing instrument and the transfer function of the feedback path. The feedback path is a passive system, so that its total amplification is always less than 0 dB. The hearing instrument normally delivers an amplification greater than 0 dB. Without any feedback suppression, a hearing instrument begins to generate whistling interfering noises if the total amplification of the CLTF is greater than 0 dB, since the sound signal generated by the loudspeaker is always further amplified in this case via the closed signal loop. The invention therefore makes use of the realization that, for feedback suppression, the transfer function of the feedback path is usually at least approximately known, whereas the transfer function of the main signal path in the hearing instrument is known. The invention now recognizes that a condition can be established on the basis of the estimated transfer function of the closed signal loop to determine when the feedback suppression should preferably not be modified.

It must be emphasized in this connection that many hearing instruments apply a signal processing of the input signal in which the dynamic range is compressed, i.e. the amplification is reduced in the signal processing for signal components in the input signal which have been generated by loud sound signals. Since the source of the user's own voice, i.e. the mouth, is normally relatively close to the hearing instrument, the user's own voice is usually perceived by the hearing instrument as a correspondingly loud sound signal and is thus less amplified by the signal processing as a result of the compression. The CLTF is also reduced as a result. This surprising realization that the risk of feedback whistling is normally reduced by a compression in the signal processing during a user's own voice activity is exploited by the invention in a particularly advantageous manner.

It also proves to be more advantageous here if the decorrelation of the intermediate signal to form the output signal is performed in a normal mode if an absence of a voice activity of the user of the hearing instrument is detected. The compensation signal is generated on the basis of the output signal which is formed from the intermediate signal decorrelated in normal mode, and the compensation signal is fed to the input signal for feedback compensation, and/or if the decorrelation of the intermediate signal to form the output signal is performed in a special mode if a voice activity of the user of the hearing instrument is detected and if the total amplification of the transfer function of the closed signal loop does not exceed a predefined limit value. The intermediate signal is decorrelated in special mode with a lower decorrelation strength than in normal mode.

In particular, the correlation strength is defined via modifications of the correlation function by the decorrelation. Examples of a specific form of reduction of the correlation strength are a frequency shift by a smaller amount in the frequency domain or a phase modulation at a lower modulation frequency. Generally speaking, a decorrelation is often performed in a hearing instrument only within a specific range. The lower frequencies are often left unchanged. In this case, a lower decorrelation strength is also achieved by a reduction of the range in which the decorrelation is applied.

In particular, a presence or absence of the hearing instrument user's own voice activity is detected using a probability model and, where appropriate, a corresponding threshold, i.e. a value for the probability of the presence or absence of a voice activity is determined in the input signal, compensated if necessary by the compensation signal, from the sound pattern, i.e., inter alia, particularly from the amplitudes, the frequency spectrum and autocorrelations. If the value is above a threshold, a voice activity is assumed. In particular, the reduction of the decorrelation strength in special mode is dependent on the probability value, i.e. the more certain it is that a voice activity is present, the less the intermediate signal is decorrelated.

The indicated design offers the facility to perform the feedback suppression in the case where an absence of voice activity can be determined or if no voice activity can be detected, with the optimum parameters for interfering noise suppression, signal quality and freedom from signal artefacts. However, in the case where a voice activity is detected, the individual auditory perception of the user of the hearing instrument is furthermore temporarily prioritized and feedback suppression is moreover, where appropriate, attenuated or stopped. However, this is possible precisely because the transition to special mode is dependent on an uncritical total amplification of the closed signal loop containing the main signal path and the feedback path.

In special mode, the decorrelation of the intermediate signal is favorably deactivated here so that the decorrelation strength is reduced to zero. Through a complete stoppage of the decorrelation, the sound signal generated by the loudspeaker and a sound signal fed via bone conduction to the hearing of the user have no noteworthy differences except for delays below the perception threshold. A particularly pleasant auditory perception is thereby achieved for the user of the hearing instrument when speaking. A procedure of this type is advantageous, particularly in the case of a detection of voice activity with a high certainty.

The compensation of the input signal is preferably stopped by the compensation signal if the decorrelation of the intermediate signal is performed in special mode. This is particularly favorable if the decorrelation is stopped completely in special mode. The reason for this is that a precise estimation of the acoustic feedback path cannot normally be satisfactorily achieved without a decorrelation, and, in this case, audible and interfering artefacts may occur, particularly for tonal noises as the input signal. During this time, the last-estimated feedback path can then be kept constant, and the only time-dependent factor which influences the CLTF is the signal processing in the hearing instrument, which is known. In this design, a residual risk remains that the feedback path is modified and, in particular, amplified while the user of the hearing instrument talks for a lengthy period. In this case, a feedback whistling could occur until the user stops speaking. In practice, however, this risk of a persistent feedback whistling is very low since short pauses are normally inserted between individual phrases or sentences, even during lengthy discourse. The CLTF can therefore undergo an updating, since the decorrelation and feedback suppression are activated in a speech pause of this type.

An adaptive filter preferably estimates the transfer function of the feedback path on the basis of the output signal, the compensation signal and the input signal, the transfer function being incorporated into the transfer function of the closed signal loop. The adaptive filter is thus used, on the one hand, to suppress the feedback if, in particular, no voice activity is present, and, on the other hand, the filter coefficients can be used to estimate the transfer function of the acoustic feedback path.

In a different advantageous embodiment of the idea, the adaptive filter furthermore estimates the transfer function of the acoustic feedback path during a decorrelation in special mode by use of the filter coefficients, but the compensation signal generated by the filter coefficients is not fed to the main signal path for subtraction from the input signal. The error signal resulting from the difference between the input signal and the compensation signal is used only to further estimate the feedback path in the adaptive filter. This is referred to as a shadow filter approach. The estimated compensation signal is not subtracted in the main signal path, since it could result in audible artefacts due to the low decorrelation and therefore high correlation between the input signal and the output signal which are used to form the compensation signal. The estimated feedback path is used here to update the CLTF only in time periods without decorrelation.

It must be emphasized here that the estimated feedback path is not as precisely known in these time periods as it would be if the decorrelation were activated. In the case of a tonal sound signal for generating the input signal, the feedback path is normally overestimated, i.e. a stronger acoustic feedback is assumed than is really present. In this design, the decorrelation could therefore be performed erroneously in normal mode if the feedback path is overestimated and the total amplification of the closed signal loop is estimated as being too high as a result.

It proves to be further advantageous if the adaptation speed is reduced in the adaptive filter for estimating the transfer function of the feedback path if the decorrelation of the intermediate signal is performed in special mode. The aforementioned overestimation of the feedback path can be reduced as a result.

The intermediate signal is favorably decorrelated by frequency distortion. A frequency distortion contains, in particular, a frequency shift and a phase modulation. A decorrelation by frequency distortion is an effective method that is particularly advantageous in practice for preventing the occurrence of artefacts in the output signal and/or incorrect adaptations during feedback suppression. Furthermore, precisely the differences between a voice sound conducted by the jawbone of the user of the hearing instrument and a sound signal of the hearing instrument decorrelated by a frequency distortion often result in an unpleasant auditory perception for the user as a result of the ensuing beats and interference between the two signals, so that the indicated method is particularly advantageous here.

The invention furthermore designates a hearing instrument, in particular a hearing aid, which contains at least one microphone for generating an input signal, at least one loudspeaker for reproducing an output signal, a monitoring unit for monitoring a voice activity of the user of the hearing instrument, and a control unit. The control unit is configured to suppress feedback of the output signal reproduced via the at least one loudspeaker into the input signal generated by the at least one microphone by the method described above. The advantages specified for the method and its developments can be transferred accordingly to the hearing instrument.

Other features which are considered as characteristic for the invention are set forth in the appended claims.

Although the invention is illustrated and described herein as embodied in a method for suppressing feedback in a hearing instrument, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and quantities corresponding to one another are denoted in each case with the same reference numbers in all figures.

Figure 1:
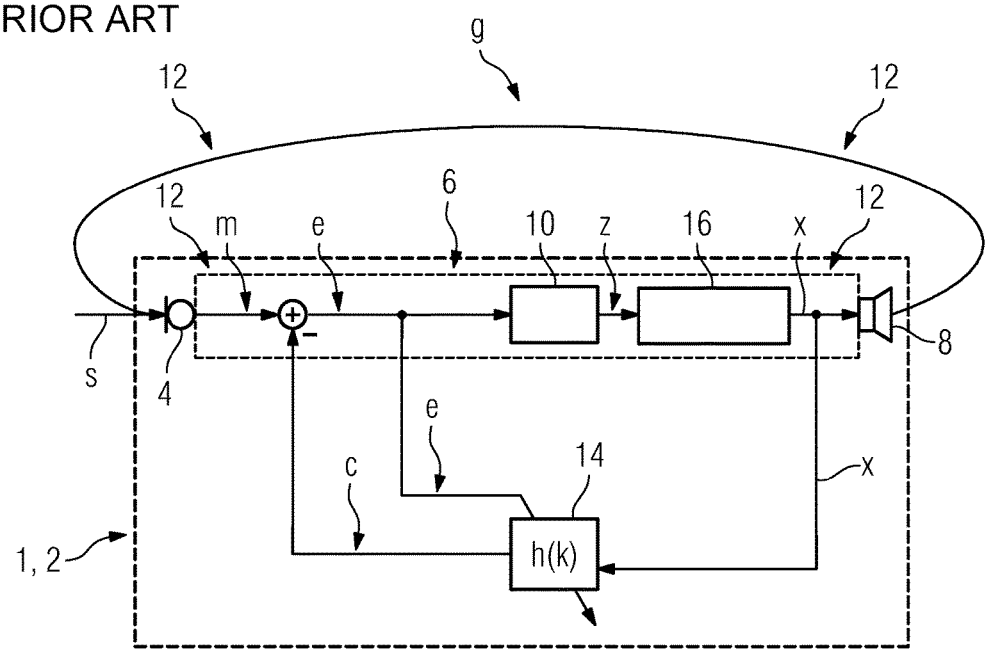
FIG 1 PRIOR ART
FIG. 1 is a block diagram showing a method for suppressing feedback in a hearing instrument according to the prior art.

Referring now to the figures of the drawings in detail and first, particularly to FIG. 1 thereof, there is shown schematically a block diagram of a hearing instrument 1 which is configured here as a hearing aid 2. The hearing instrument 1 contains a microphone 4 which generates an input signal m from an ambient sound signal s. The input signal m is further processed along a main signal path 6 in the hearing instrument 1 in various signal processing stages, which have still to be described, to form an output signal x which is fed to a loudspeaker 8 of the hearing instrument 1 for reproduction. The output signal x reproduced by the loudspeaker 8 can be partially fed back via an acoustic feedback path g to the microphone 4. In a signal processing unit 10, an amplification of a signal obtained from the input signal m takes place, inter alia, in the main signal path 6. If the input signal m were then amplified in the signal processing unit 10 and output directly as the output signal x to the loudspeaker 8 for reproduction, a signal would be still further amplified in the electro-acoustic closed signal loop 12 which is formed by the main signal path 6 and the acoustic feedback path g, so that an interfering whistling noise would be generated by the feedback. The feedback is suppressed by an adaptive filter 14 in order to prevent this.

The adaptive filter 14 receives the output signal x which is to be output to the loudspeaker 8 for reproduction and, by the filter coefficients h(k), generates from the output signal a compensation signal c which is subtracted from the input signal m to compensate for the feedback. The error signal e resulting from this subtraction is then also incorporated in turn into the adaptive filter 14 as a control parameter to determine the filter coefficients h(k) and is fed in the main signal path 6 to the signal processing unit 10 for amplification and for further signal processing. In order to prevent the adaptive filter 14 from also eliminating tonal components from the input signal m which correspond to a useful signal in the sound signal s, the result of the signal processing unit 10 is not fed directly to the adaptive filter 14. Instead, the signal processing unit initially generates an intermediate signal z which is then decorrelated by a frequency distortion 16 for a better performance of the adaptive filter 14 in the feedback suppression. The output signal x which is fed to the loudspeaker 8 for reproduction or to the adaptive filter 14 in order to generate the compensation signal c is therefore the intermediate signal z which results from the signal processing unit 10 in the main signal path 6 and which has been decorrelated by the frequency distortion 16.

If the sound signal s which is picked up by the microphone 4 of the hearing instrument 1 contains the voice of a user of the hearing instrument 1, the user can perceive his own voice on the one hand directly, for example via bone conduction of the jawbone, and, on the other hand, through the hearing instrument 1. However, due to the frequency distortion 16, the two signals do not correspond exactly to one another, which may result in interference or beats of the two signals, which, generally speaking, is often perceived as very unpleasant by a user of the hearing instrument 1. One solution to this problem is provided by the method which is described with reference to FIG. 2.

Figure 2:
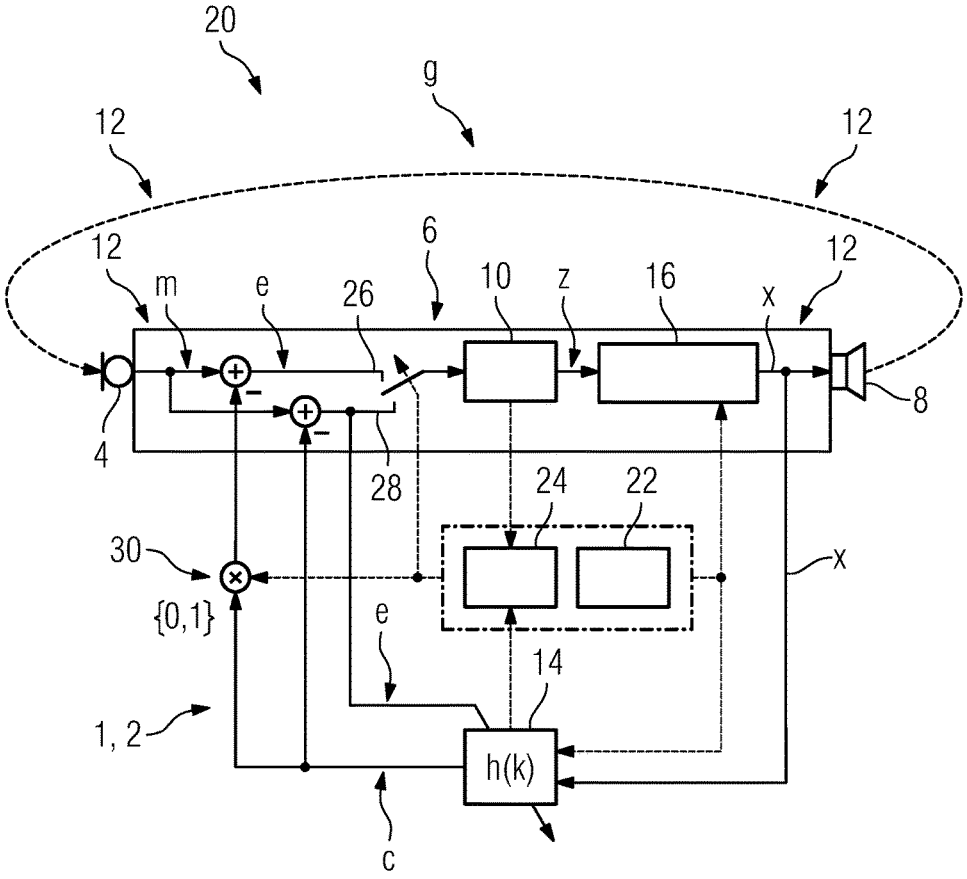
FIG. 2 is a block diagram showing a method for suppressing feedback in a hearing instrument with a decorrelation that can be deactivated through voice detection according to the invention.

FIG. 2 shows schematically, in a block diagram, a method 20 in which a voice recognition unit 22 is provided to suppress feedback in the hearing instrument 1 and to detect a voice activity, depending on which the decorrelation is activated or deactivated or attenuated by the frequency distortion 16. As long as the voice recognition unit 22 detects no voice activity whatsoever on the part of the user of the hearing instrument 1, the feedback suppression in relation to the signals generated in the hearing instrument 1, i.e. in particular the output signal m, the compensation signal c, the error signal e, the intermediate signal z and the output signal x, proceeds as shown in FIG. 1.

However, if a voice activity of the user of the hearing instrument 1 is detected by the voice recognition unit 22, a check is carried out in a next step to determine whether the transfer function 24 of the electro-acoustic closed signal loop 12 has a total amplification which lies below a predefined limit value. If so, the feedback suppression process can be modified at least for the time period of the voice activity of the user of the hearing instrument 1 without running the risk of a feedback-induced whistling noise being produced. For this purpose, the limit value for the total amplification in the closed signal loop 12 must be selected accordingly with a certain safety margin below the system-critical value of 0 dB.

The transfer function 24 of the closed signal loop 12 makes use here, on the one hand, of the knowledge of the signal processing algorithms used in the signal processing unit 10, the knowledge of the response behavior and the frequency response of the microphone 4 and the loudspeaker 8, and an estimation value for the transfer function of the acoustic feedback path g which is estimated by the adaptive filter 14 on the basis of the filter coefficients k(h).

If, in the case where a voice activity of the user of the hearing instrument 1 has been detected by the voice recognition unit 22, the total amplification of the closed signal loop 12 lies below the predefined limit value, the frequency distortion 16 for generating the output signal x from the intermediate signal z is attenuated. An attenuation of the frequency distortion is preferably to be defined here via the correlation of the frequency-distorted output signal x with the intermediate signal z which has not yet been frequency-distorted, so that an attenuation of the frequency distortion results, in particular, in a smaller modification of the correlation function. If, for example, the frequency distortion 16 is provided by an—if necessary time-dependent—frequency shift, the attenuation of the frequency shift is provided by a reduction in the amount by which the frequency of the intermediate signal z is shifted to form the output signal x. In the case of a phase modulation as the frequency distortion 16, an attenuation of the frequency distortion can be achieved by a reduced modulation frequency.

Through the reduction of the frequency distortion 16, the output signal x is no longer adequately decorrelated in relation to the error signal e, so that the formation of audible artefacts could occur in the feedback suppression by the compensation signal c generated by the adaptive filter 14 in the main signal path 6 and thus in the output signal x. In this case, the filter 14 can be bypassed in the main signal path 6, a subtraction of the compensation signal c then takes place only for the calculation of the filter coefficients h (which are required for the estimation of the feedback path g in the closed signal loop 12). The microphone signal m is temporarily forwarded directly to the central signal processing 10 for the time period of the detected voice activity (upper switching path 26 in the bifurcation). This can be achieved alternatively via a controllable activation factor 30 (e.g. 0 or 1) by which the compensation signal c is to be multiplied depending on the aforementioned conditions.

In the case where the voice recognition unit 22 detects no voice activity, the intermediate signal z is decorrelated in a manner similar to the block diagram shown in FIG. 1 by the frequency distortion 16 with the decorrelation strength provided for a normal feedback suppression operation and the output signal x is thus formed. From the latter, the adaptive filter 14 generates the compensation signal c, which is subtracted from the microphone signal m (lower switching path 28 in the bifurcation), for the feedback suppression.

Although the invention has been illustrated and described in detail by means of the preferred example embodiment, the invention is not limited by this example embodiment. Other variations can be derived herefrom by the person skilled in the art without exceeding the protective scope of the invention.

The following is a summary list of reference numerals and the corresponding structure used in the above description of the invention:

1 Hearing instrument
2 Hearing aid
4 Microphone
6 Main signal path
8 Loudspeaker
10 Signal processing unit
12 Closed signal loop
14 Adaptive filter
16 Decorrelation, frequency distortion
20 Method
22 Voice recognition unit
24 Transfer function of the closed loop
26 Upper switching path in the bifurcation
28 Lower switching path in the bifurcation
30 Activation factor

The invention claimed is:

1. A method for suppressing feedback in a hearing instrument, which comprises the steps of:

generating an input signal via a microphone of the hearing instrument;

generating an acoustic signal at a loudspeaker of the hearing instrument, the acoustic signal being partially fed back to the microphone via an acoustic feedback path;

generating an intermediate signal along a main signal path depending on the input signal;

forming an output signal on a basis of the intermediate signal;

monitoring voice activity of a user of the hearing instrument;

estimating a transfer function of an electro-acoustic closed signal loop formed by the main signal path and the acoustic feedback path;

determining whether the transfer function of the electro-acoustic closed signal loop has a total amplification which lies below a predefined limit value;

depending on a result of the determining step and the voice activity of the user of the hearing instrument, performing the following steps of:

decorrelating the intermediate signal to form the output signal;

generating a compensation signal on a basis of the output signal and feeding the compensation signal to the input signal for feedback compensation; and feeding the output signal to the loudspeaker for reproduction.

2. The method according to claim 1, wherein, if an absence of the voice activity of the user of the hearing instrument is detected, performing the further steps of:

performing decorrelation of the intermediate signal to form the output signal in a normal mode;

generating the compensation signal on a basis of the output signal formed from the intermediate signal decorrelated in the normal mode;

feeding the compensation signal to the input signal for feedback compensation; or wherein, if the voice activity of the user of the hearing instrument is detected, performing the decorrelation of the intermediate signal to form the output signal in a special mode if a total amplification of the transfer function of the electro-acoustic closed signal loop does not exceed a predefined limit value, and the intermediate signal is decorrelated in the special mode with a lower decorrelation strength than in the normal mode.

3. The method according to claim 2, wherein, in the special mode, the decorrelation of the intermediate signal is deactivated so that a decorrelation strength is reduced to zero.

4. The method according to claim 2, wherein compensation of the input signal by means of the compensation signal is stopped if the decorrelation of the intermediate signal is performed in the special mode.

5. The method according to claim 1, which further comprises using an adaptive filter to estimate a transfer function of the feedback path on a basis of the output signal, the compensation signal and the input signal, the transfer function of the feedback path being incorporated into the transfer function of the electro-acoustic closed signal loop.

6. The method according to claim 5, wherein an adaptation speed is reduced in the adaptive filter for estimating the transfer function of the feedback path if the decorrelation of the intermediate signal is performed in the special mode.

7. The method according to claim 1, wherein the intermediate signal is decorrelated by means of frequency distortion.

8. A hearing instrument, comprising:

at least one microphone for generating an input signal;

at least one loudspeaker for reproducing an output signal;

a voice recognition unit for monitoring voice activity of a user of the hearing instrument; and a control unit configured to suppress feedback of the output signal reproduced via said at least one loudspeaker into the input signal generated by said at least one microphone by means of a method according to claim 1.

* * * * *